United States Patent [19]

Hitzrot, Jr.

[11] 4,432,803

[45] Feb. 21, 1984

[54] IRON OXIDE PAINT PIGMENT PRECURSOR

[75] Inventor: Henry W. Hitzrot, Jr., Bethlehem, Pa.

[73] Assignee: Bethlehem Steel Corporation, Bethlehem, Pa.

[21] Appl. No.: 226,680

[22] Filed: Jan. 21, 1981

Related U.S. Application Data

[63] Continuation-in-part of Ser. No. 103,144, Dec. 13, 1979, abandoned, which is a continuation-in-part of Ser. No. 965,550, Dec. 1, 1978, Pat. No. 4,190,422, which is a continuation-in-part of Ser. No. 906,310, May 16, 1978, abandoned, which is a continuation in-part of Ser. No. 800,116, May 24, 1977, abandoned.

[51] Int. Cl.[3] ..... C09C 1/24

[52] U.S. Cl. ..... 106/304

[58] Field of Search ..... 106/304

[56] References Cited

U.S. PATENT DOCUMENTS

| | | | |
|---|---|---|---|
| 1,979,595 | 11/1934 | Wood | 106/304 |
| 2,656,282 | 10/1953 | Clarke | 106/304 |
| 3,276,894 | 10/1966 | Hund et al. | 106/304 |
| 3,755,554 | 8/1973 | Lailach et al. | 106/304 X |
| 4,234,348 | 11/1980 | Brunn et al. | 106/304 |

*Primary Examiner*—Carl F. Dees

*Attorney, Agent, or Firm*—John I. Iverson; William B. Noll; John J. Selko

[57] ABSTRACT

The iron oxide paint pigment precursor used in a process for producing such paint pigment is found in scarfer spittings, a steel mill waste product. The cores are characterized by a chemical composition comprised of between about 0.04 and 0.10 weight percent carbon, about 0.06 and 0.25 weight percent manganese, about 0.015 and 0.025 weight percent phosphorus, less than about 0.05 weight percent silicon, less than 0.01 weight percent sulfur, about 94 and 98 weight percent iron and the remainder oxygen and incidental impurities and a particle size within the range of 5 mm to 0.125 mm.

3 Claims, No Drawings

IRON OXIDE PAINT PIGMENT PRECURSOR

CROSS-REFERENCES

This is a continuation-in-part of my application Ser. No. 103,144 filed Dec. 13, 1979, abandoned, entitled "Steel Mill Waste Material" which is a continuation-in-part of application Ser. No. 965,550 filed Dec. 1, 1978, now U.S. Pat. No. 4,190,422 entitled "Metallic Abrasive Produced From A Steel Mill Waste Material" which is a continuation-in-part of application Ser. No. 906,310 filed May 16, 1978, abandoned, which is a continuation-in-part of application Ser. No. 800,116 filed May 24, 1977, abandoned, entitled "Method For Treating Waste Product To Produce Metallic Abrasive Material."

BACKGROUND OF THE INVENTION

This invention is directed to a precursor for iron oxide paint pigment composed of metallic cores found in scarfer spittings, a steel mill waste material.

Scarfer spittings are a steel mill waste material produced by scarfing steel blooms, slabs and billets prior to or during processing to remove surface defects. Scarfing consists of rapidly removing the surface of steel by the use of a fuel containing oxygen applied to the surface by means of a torch or torches. The oxygen oxidizes a portion of the steel thereby generating heat and increasing the temperature to cause the steel to become molten. The partially oxidized generally globular product thus formed is referred to as scarfer spittings. The scarfer spittings are cooled and flushed from the surface of the steel by high pressure water and are collected in a water bath. The scarfer spittings range in size from smaller than 0.149 mm to larger than 50.8 mm in diameter and are generally comprised of an outer brittle shell composed substantially of iron oxides and an inner metallic core.

At the present time scarfer spittings have no specific use other than recycling in the steel mill to recover the iron which they contain. A portion of the spittings are mixed with mill scale, steel borings and the like and are used as part of the charge to a sinter strand to recover the iron. However, only the larger sized particles or spittings can be so used. In recent years, increased emphasis on the surface cleanliness of steel has resulted in an increase in the use of automatic scarfing machines to scarf the steel surfaces. As a result, the volume of scarfer spittings produced in a steel mill has increased, thereby increasing the time required to transport the spittings and the amount of storage space required for the spittings. There is, therefore, a need to find an economical use for the scarfer spittings.

It is the object of this invention to provide an iron oxide paint pigment precursor comprised of metallic cores recoverd from a steel mill waste product, i.e. scarfer spittings, produced during the scarfing of steel.

SUMMARY OF THE INVENTION

According to this invention, the metallic cores which form a portion of the scarfer spittings produced during the scarfing of steel and which are a steel plant waste material are used as a raw material in the production of yellow iron oxide paint pigment. The scarfer spittings are comprised of outer shells of iron oxides surrounding inner metallic cores. The spittings are treated to remove all the brittle outer shells from the surfaces of the metallic cores. The cores are separated from the shells by screening and are in turn screened and the particles having a size within the range of −5 mm to +0.125 mm are used to produce yellow iron oxide paint pigment in such processes as the aniline or sulfate processes. Such processes produce alpha FeOOH, a yellow iron oxide paint pigment.

The metallic cores are characterized by having a chemical composition comprised of between about 0.04 and 0.10 weight percent carbon, about 0.06 and 0.25 weight percent manganese, about 0.005 and 0.025 weight percent phosphorus, less than 0.01 weight percent sulfur, less than about 0.05 weight percent silicon, less than about 0.04 weight percent chromium, between about 94 and 98 weight percent iron, the remainder incidental impurities and oxygen.

PREFERRED EMBODIMENT OF THE INVENTION

It has been found that metallic cores which form a portion of the scarfer spittings, a steel mill waste product formed during scarfing of steel, can be used as a precursor or basic material in producing yellow iron oxide paint pigments in the aniline or sulfate processes.

As noted previously, scarfer spittings are comprised of an outer shell of oxidized iron surrounding a generally spherical inner metallic core. Generally, low carbon rimming steels and other low carbon and low alloy grades of steel are scarfed with automatic scarfing machines. The scarfer spittings produced by such scarfing can be treated by a process as described in U.S. Pat. No. 4,190,422 issued Feb. 26, 1980 and entitled "Metallic Abrasive Produced From A Steel Mill Waste Material." It was previously thought that the cores contain the same weight percentages of the elements originally found in the steel being scarfed. Unexpectedly, it has been found that some elements, for example manganese, apparently migrate to the outer shells and the cores actually contain lower percentages of such elements than are in the parent steel. The cores are therefore "purer" in iron than the scarfed steel. Scrap iron which is usually used in aniline and sulfate processes are contaminated with relatively high amounts of elements such as manganese, chromium and the like. While these scrap irons can be used in the processes they cannot be used to produce yellow iron oxide paint pigment. Elements such as noted above have a detrimental effect on the color of the iron oxide pigment formed by the oxidation of iron, hence only the relatively pure iron yields an iron oxide pigment which has a lemon yellow color. By regulating the oxidation of the iron to form iron oxide hydrate ($\alpha$-FeOOH) and by blending and/or heat treatment other iron oxide pigments having colors such as henna, red, red-brown, brown and the like can be produced.

To produce the yellow iron oxide paint pigment the iron to be oxidized must have the following characteristics and chemical composition:

1. It must have a particle size within the range of not more than 5 mm in diameter and should not be smaller than 0.42 mm in diameter.

2. It should have the following chemical composition:
   not more than 0.1 weight percent carbon
   not more than 0.5 weight percent manganese
   not more than 0.1 weight percent silicon
   not more than 0.1 weight percent chromium.

Heretofore, the restricted chemical composition shown above was obtained by melting special heats of steel in a furnace, for example an electric furnace. The steel was comminuted to meet the specified particle size. Such special processing adds to the cost of the iron oxide pigment.

Unexpectedly, the relative "pure" metallic cores of scarfer spittings were found to have lesser contents of elements such as manganese, silicon and chromium than the steel from which the spittings originated. As noted previously, apparently the above-mentioned elements migrate to and become concentrated in the iron oxide shells of the spittings. Removal of the shells from the cores results in the removal of a substantial portion of the elements manganese, silicon and chromium, leaving the relatively "pure" cores.

It has been discovered that by removing the oxide shells of scarfer spittings derived from the plain low carbon or low alloy steel mix of the average steel plant from around the metallic cores and separating the shells from cores, the cores can be screened to a size range suitable for use as a raw material for the production of yellow iron oxide paint pigment.

The metallic cores obtained by treating the scarfer spittings produced when low carbon or low alloy grades of steel are scarfed can be screened to produce a size consist in which the particles are within the range of −5 mm and +0.125 mm and have a typical chemical composition which is less than 0.1 weight percent carbon, less than 0.5 weight percent manganese, less than 0.1 weight percent silicon and less than 0.1 weight percent chromium and may contain residual amounts of nickel, copper and the like, for example scarfing a steel slab having a chemical composition shown below:

0.22 weight percent carbon
0.67 weight percent manganese
0.05 weight silicon
0.029 weight percent chromium
97.6 weight percent metallic iron, the remainder incidental impurities normally found in such steels, produced scarfer spittings having metallic cores with an average chemical composition shown below:

0.08 weight percent carbon
0.045 weight percent manganese
0.01 weight percent silicon
0.005 weight percent chromium
95.6 weight percent metallic iron, the remainder incidental impurities usually found in such steels.

To obtain the relatively "pure" cores as shown above the scarfer spittings were treated according to the process shown in the previously mentioned U.S. Pat. No. 4,190,422 to remove the shells from the surfaces of the cores and to separate the shells from the cores. The cores were screened on a plurality of screens to produce a size consist wherein the particles were within the range of −5 mm to +0.125 mm.

Metallic cores within a size range between about 5 mm and 0.125 mm and preferably between about 5 mm and 0.42 mm can be used as iron oxide pigment precursor in well-known wet processes for producing yellow iron oxide pigment, for example as described in the Bureau of Mines Information Circular, IC8771 by Thomas S. Jones, 1978, p. 57–58 or in the sulfate process as described in U.S. Pat. No. 1,327,061 to R. S. Penniaman, Jr. et al entitled "Process of Manufacturing Iron Compounds" and U.S. Pat. No. 2,939,767 to J. Martin entitled "Manufacture of Iron Oxides" which are directed to the production of yellow iron oxide paint pigment.

In a specific example of the invention, about 59 kilograms of scarfer spittings were treated by the process hereinbefore described. About 8 kilograms of cores containing 0.043 percent weight carbon, 0.10 weight percent manganese, 0.01 weight percent silicon, 0.01 weight percent chromium, the remainder substantially iron and traces of incidental impurities normally found in low carbon sheet grade steel having a size consist of −5.35 mm, 0.421 mm. A solution containing 3 liters of water, 2.7 liters of 35 volume percent $AlCl_3$ and 0.5 volume percent excess of HCl together with 7.6 kilograms of nitrobenzene were pumped into an autoclave having a capacity of 15 liters. The autoclave was equipped with a feed port, a stirrer, a steam input pipe and a reflux condenser for the distillate. The cores were slowly fed into the solution in the autoclave over a period of about 10 to 12 hours. The mixture was agitated with the stirrer revolving at about 35 rpm. After a period of 24 hours, the reaction ceased and the water was drained from the autoclave and the aniline distilled off. The residue remaining in the autoclave consisted of fine particles of crude iron oxide and liquid. The liquid was steamed off and the autoclave filled with water. The water-iron oxide mixture was pumped to a settling tank to separate the iron oxide and water. The oxide was purified to remove unreacted iron and residual salts. The oxide was dried and tested by ASTM D 768 to determine the intensity of the color. To the unaided eye the color was a vivid yellow. The iron oxide was then pulverized and used as iron oxide pigment.

I claim:

1. In a process for producing yellow iron oxide paint pigment wherein iron-containing particles together with nitrobenzene, aluminum chloride and hydrochloric acid are charged into an autoclave and are heated under pressure, and the nitrobenzene is reduced to aniline and substantially all the iron is oxidized to iron oxides with a negligible amount of iron remaining unreacted and a negligible amount of residual salts are formed as well as water; and wherein the aniline is separated from the iron oxides, the unreacted iron and the residual salts and the water, and the iron oxides are treated to remove the unreacted iron and the residual salts to leave substantially pure yellow iron oxides, the iron-containing particles which are charged into the autoclave being a waste material comprised of metallic cores derived from scarfer spittings and characterized by a composition consisting essentially of not more than:

0.10 weight percent carbon,
0.25 weight percent manganese,
0.025 weight percent phosphorus.
0.01 weight percent sulfur,
0.05 weight percent silicon,
0.10 weight percent chromium, the remainder iron and having a particle size within the range of about 5 mm and 0.125 mm.

2. A process according to claim 1 wherein the metallic cores have a composition consisting essentially of:

between about 0.04 and 0.1 weight percent carbon,
between about 0.06 and 0.25 weight percent manganese,
between about 0.005 and 0.025 wt. percent phosphorus,
less than about 0.01 weight percent sulfur,
less than about 0.05 weight percent silicon,
less than about 0.10 weight percent chromium, the remainder iron.

3. A process in accordance with either claim 1 or 2 in which the size of the metallic cores is within the range of 5 mm and 0.42 mm.

* * * * *